US005325693A

United States Patent [19]

Hoffmann et al.

[11] Patent Number: 5,325,693

[45] Date of Patent: Jul. 5, 1994

[54] APPARATUS FOR THE CONTINUOUS PRODUCTION OF HELICAL OR ANNULAR CORRUGATED METAL TUBES

[75] Inventors: Ernst Hoffmann, Langenhagen; Wolfram Klebl, Isernhagen; Harry Staschewski, Langenhagen, all of Fed. Rep. of Germany

[73] Assignee: Kabelmetal Electro GmbH, Hanover, Fed. Rep. of Germany

[21] Appl. No.: 976,146

[22] Filed: Nov. 10, 1992

[30] Foreign Application Priority Data

Nov. 13, 1991 [DE] Fed. Rep. of Germany ..... 4137275

[51] Int. Cl.[5] ..... B21D 15/04

[52] U.S. Cl. ..... 72/19; 72/77

[58] Field of Search ..... 72/77, 78, 19

[56] References Cited

U.S. PATENT DOCUMENTS 3,208,256 9/1965 Lehnert ..... 72/77
3,486,357 12/1969 Raisch ..... 72/77
3,656,331 4/1972 Kuypers et al. ..... 72/77
3,732,717 5/1973 Ahlvers ..... 72/77
4,501,134 2/1985 Staat et al. ..... 72/78

FOREIGN PATENT DOCUMENTS 0128223 7/1983 Japan ..... 72/78
0021330 5/1990 Japan ..... 72/78

*Primary Examiner*—Daniel C. Crane
*Attorney, Agent, or Firm*—Ware, Fressola, Van Der Sluys & Adolphson

[57] ABSTRACT

In a process for the continuous production of helical or annular corrugated, thin-walled, in particular longitudinally welded metal tubes, in which a freely rotating roller ring in a turntable corrugation head, which is eccentric with respect to the smooth metal tube, rolls against the smooth surface of the metal tube to produce the corrugation, and the metal tube is transported by a traction device that grips the smooth and/or corrugated metal tube, the force acting on the roller ring is constantly measured, and the rotation speed of the head is controlled as a function of the measured force.

5 Claims, 4 Drawing Sheets

APPARATUS FOR THE CONTINUOUS PRODUCTION OF HELICAL OR ANNULAR CORRUGATED METAL TUBES

TECHNICAL FIELD

The invention concerns a process for the continuous production of helical or annular corrugated, thin-walled, in particular longitudinally welded metal tubes, in which a freely rotating roller ring in a turntable corrugation head that is eccentric with respect to the corrugated metal tube, rolls against the surface of the smooth metal tube to produce the corrugation, and the metal tube is transported by a traction device that grips the smooth and/or corrugated metal tube.

BACKGROUND OF THE INVENTION

In this type of process (DE-AS 16 52 990), the corrugation head bearing, which is located in a housing, permits a very limited axial displacement of the corrugation head. This displacement is not always sufficient to prevent sink marks in the tube wall, especially in the area of the weld seam, and as a result of irregularities in the metal structure of the band (hardness fluctuations). Furthermore, displacing the entire corrugation head requires extensive force, which leaves small markings in the tube material prior to the displacement, especially in thin-walled or weak band material. In extreme cases, differences in the hardness of the tube material can lead to deviations of the actual from the specified wave rise, or to tube collapse because the roller ring cannot keep up with the traction speed of the tube, or to a fracture of the roller ring, as a result of overload.

The corrugation head drive provided for a process of this type, with a coupling to the main drive motor through an infinitely variable gear, and the drive of the traction installation by the main motor, cannot fully eliminate the described defects, even with the selected limited axial displacement of the corrugation head.

It was proposed in a different type of process (DE-AS 20 49 235), in which the corrugation of the tube wall is produced by a corrugation tool that is screwed onto the smooth tube (screw corrugation process), that only the corrugation tool, i.e. the screw corrugator, be axially displaceable.

Transferring this proposal to a device with a corrugation roller failed, because of nearly unsurmountable difficulties.

The corrugation dimensions must be precisely maintained, particularly when such corrugated tubes are used as elements for the transmission of high frequency energy or signals. Sink marks in the corrugation lead to disturbing reflections of the transmitted waves, particularly at frequencies above 50 Mhz. This is even worse when the irregularities are evenly spaced.

DISCLOSURE OF INVENTION

This invention has the task of improving the corrugation rolling process mentioned in the beginning, to make possible an essentially more sensitive adaptation of the corrugation to irregularities of the process parameters, in particular irregularities of the tubing material. It should also be possible to record the production parameters.

This task is achieved, according to the present invention, by constantly measuring the force acting on the roller ring and controlling the rotation speed of the corrugation head as a function of the measured force.

The invention assumes that the force acting on the roller ring in the longitudinal direction of the corrugated tube decisively affects the shape of the corrugation and its uniformity. When the traction speed of the metal tube is specified, this force is a function of the corrugation head's RPM, the inside diameter of the roller ring, as well as the inclination of the roller ring in the corrugation head, or of the wave rise. In annular corrugated tubes, the rise of the helical form rib of the roller ring takes the place of the inclination or the wave rise.

It was shown that even small pressure changes of the roller ring quickly adapt the rotating speed of the corrugation head to the traction speed. Thus, a predetermined force or a predetermined pressure are maintained on the roller ring, by changing the "winding speed" of the corrugation head. The pressure may be such, that the corrugation head can operate by traction, by pressure or in the neutral position, depending on the desired shape of the corrugation.

For example, the adaptation of the RPM can be performed by adjusting the transmission of the infinitely variable gear in the corrugation device, if, as is the case in the state of the art, the traction and the corrugation devices have a common drive, and an infinitely variable gear is located between the drive and the corrugation device.

However, it proved to be more advantageous to have separate motors drive the traction device and the corrugation head.

In further accord with the present invention, a device for the continuous production of helical or annular shape metal tubes has the following characteristics:

a) the roller ring, and thereby the corrugation head and any mechanically attached parts, have limited axial displacement, b) the roller ring, the corrugation head, or at last a mechanically attached part, affect a force measuring device, and c) the motor driving the corrugation head as a function of the force measured by the force measuring device, is RPM-controlled.

According still further to the present invention, a rotating hollow shaft is attached to the corrugation head, with a roller bearing on the side facing away from the corrugation head, whose outside bearing shell has a pressure flange attached to the housing, and a finger bent 180° is attached to the pressure flange, whose free end encloses a force measuring box between itself and the housing.

In this configuration, the force acting on the roller ring is first transmitted to the corrugation head, which transmits the force to the hollow shaft. From the hollow shaft, the force passes to the pressure flange through the roller bearing, and from there to the finger.

The force acting on the roller ring produces a slight axial displacement of the corrugation head and the hollow shaft, thereby producing a force or pressure measurement in the force measuring box. The force in the force measuring box can be registered by a recorder, and can be used as a production record. The corrugation head's RPM may be regulated by known control circuits.

In further accord with the invention, three force measuring boxes may be placed at 120° from each other to advantage. This makes a precise measurement of the force at the pressure flange possible. The fingers are attached to the pressure flange by screws. This enables the finger to be displaced with respect to the housing flange. In this way, the force measuring boxes can be calibrated for the same value before starting the production.

Except for the roller bearing at the end of the hollow shaft, the bearings holding the hollow shaft may be rimless roller bearings. This makes an axial displacement of the hollow shaft with respect to the housing possible.

These and other objects, features and advantages of the present invention will become more apparent in light of a detailed description of a best mode embodiment thereof, as illustrated in the accompanying drawing.

BRIEF DESCRIPTION OF THE INVENTION

BEST MODE FOR CARRYING OUT THE INVENTION

Figure 1:
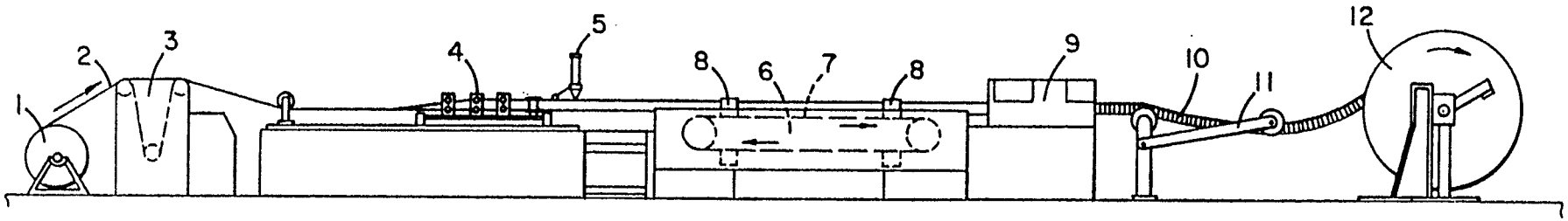
FIG. 1 shows a side view of a tube production installation.

A metal band 2 from a storage spool 1 is first cleaned in a device 3, and the longitudinal edges are trimmed. The band 2, prepared in this way, is transported to a forming device 4, where the metal band 2 is gradually shaped into an open seam tube. The open seam tube is welded into a tube with a longitudinal seam by a welding installation 5, preferably a WIG-welding installation. The traction device 6 transporting the tube is a so-called clamp jaw traction, in which guided pairs of clamp jaws S, located on an endless chain 7 running in the direction of the arrows, grip the tube. Reference numeral 9 depicts a corrugation device from which a corrugated metal tube 10 is conveyed to a drum 12 via a so-called compensating roller 11.

Figure 2:
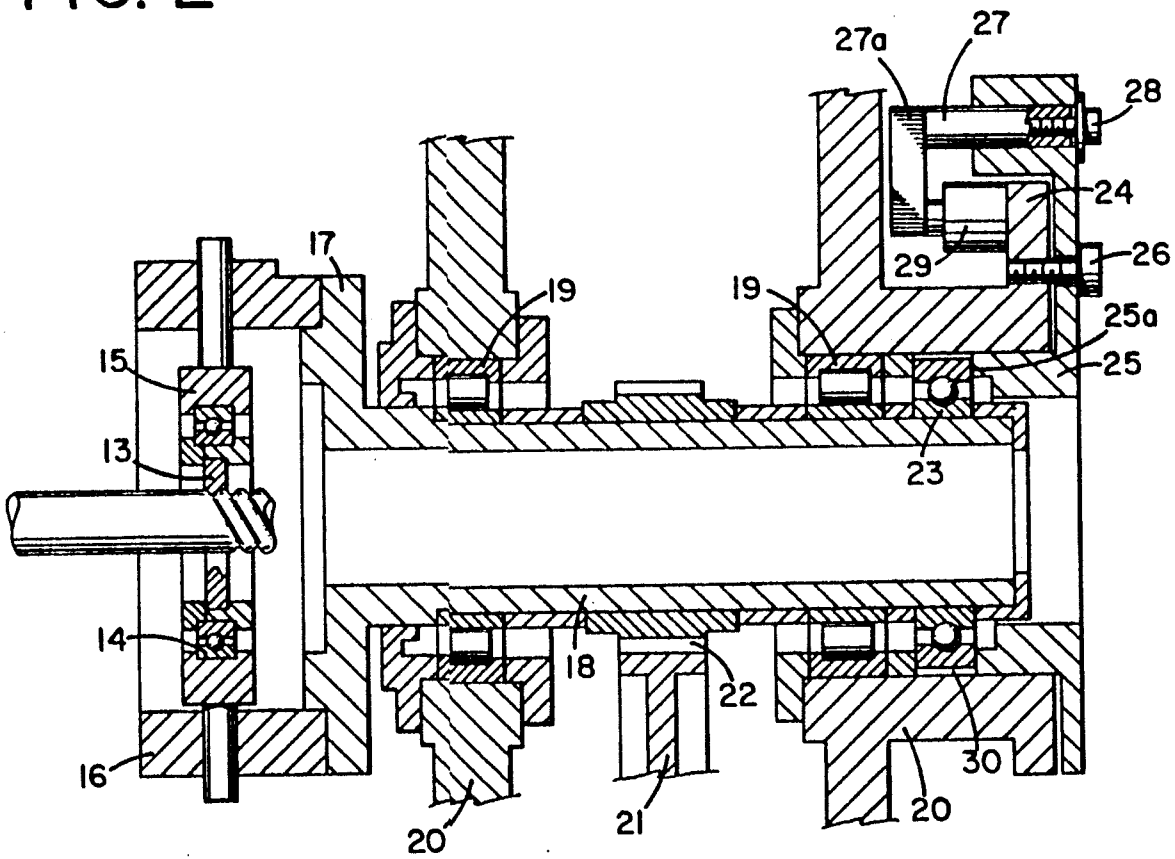
FIG. 2 shows a cut through part of the corrugation installation.

The corrugation device 9, or a part thereof, is shown enlarged in FIG. 2.

The welded tube enters the installation from the left and passes first through a roller ring 13. The roller ring 13 has a forming rib, not indicated in further detail, and rotates in a ball bearing 14 inside a roller ring holder 15. The holder 15 permits an eccentric displacement with respect to the longitudinal tube axis, as well as an angular position of the roller ring 13. The holder 15 is firmly attached to the corrugation head 16. This well known device corrugates smooth tubes by means of the rotating roller ring 13, which can roll against the surface of the smooth tube because of its eccentric arrangement, and produces a corrugation there. When the corrugation head rotates, the angular, i.e. inclined position of the roller ring 13 produces a helical corrugation in the smooth tube.

The corrugation head 16 is attached to the flange-type enlargement 17 of a hollow shaft 18, which runs on roller bearings 19 in the fixed housing 20. 21 depicts a disk operated by a not shown drive, and transmits the driving force through a gear 22 to the hollow shaft 18. A roller bearing 23, which is preferably a so-called four-point contact bearing, is provided at the end of the hollow shaft 18.

A pressure flange 25 is attached with screws 26 to a housing flange 24 in such a way, that a front face 25*a* makes contact with the outside ring of the roller bearing 23.

A finger 27 is attached with screw bolt 28 to the outer periphery of pressure flange 25. The finger 27 is an angle part that holds a force measuring sensor 29 between its angle 27*a* and the housing flange 24. Preferably three force measuring sensors, offset by 120° with respect to each other, are provided with the corresponding attaching element.

The longitudinally axial force impacting on roller ring 13 is transmitted by the ball bearing 14, the holder 15 and the corrugation head 16. Since the roller bearings 19 have no rim on the inside ring, and the hollow shaft 18 and disk 21 are locked to gear 21, the hollow shaft 18 has a limited axial displacement with respect to the housing 20. The roller bearing 23 is firmly attached to the hollow shaft 18, and receives the force from the hollow shaft 18 through the inside ring, and transmits it to the outside ring. Since there is a gap 30 between the outside ring of roller bearing 23 and the housing 20, the force is transmitted to the pressure flange 25 from the outside ring of roller bearing 23 through the front face 25*a*. The force from pressure flange 25 is transmitted to the force measuring sensor 29 through finger 27.

Figure 3:
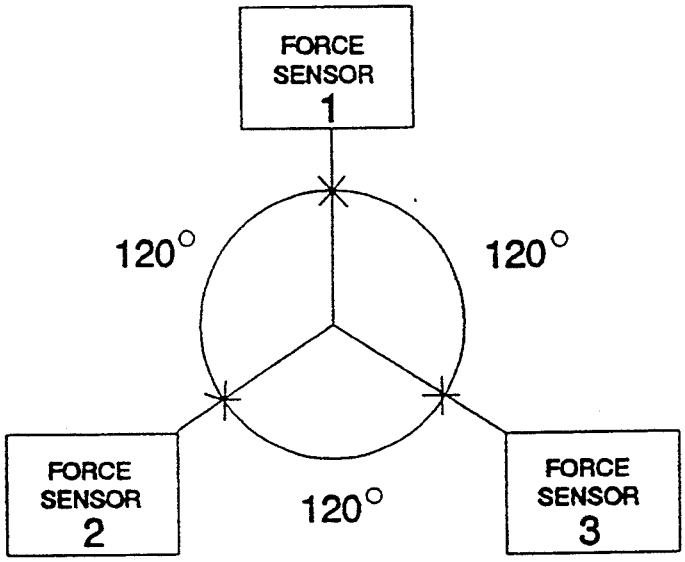
FIG. 3 shows a plurality of force sensors, according to the invention.

There may be a plurality of force sensors provided, for example three, as shown in FIG. 3 arranged at 120° intervals around the periphery of the pressure flange.

Figure 4:
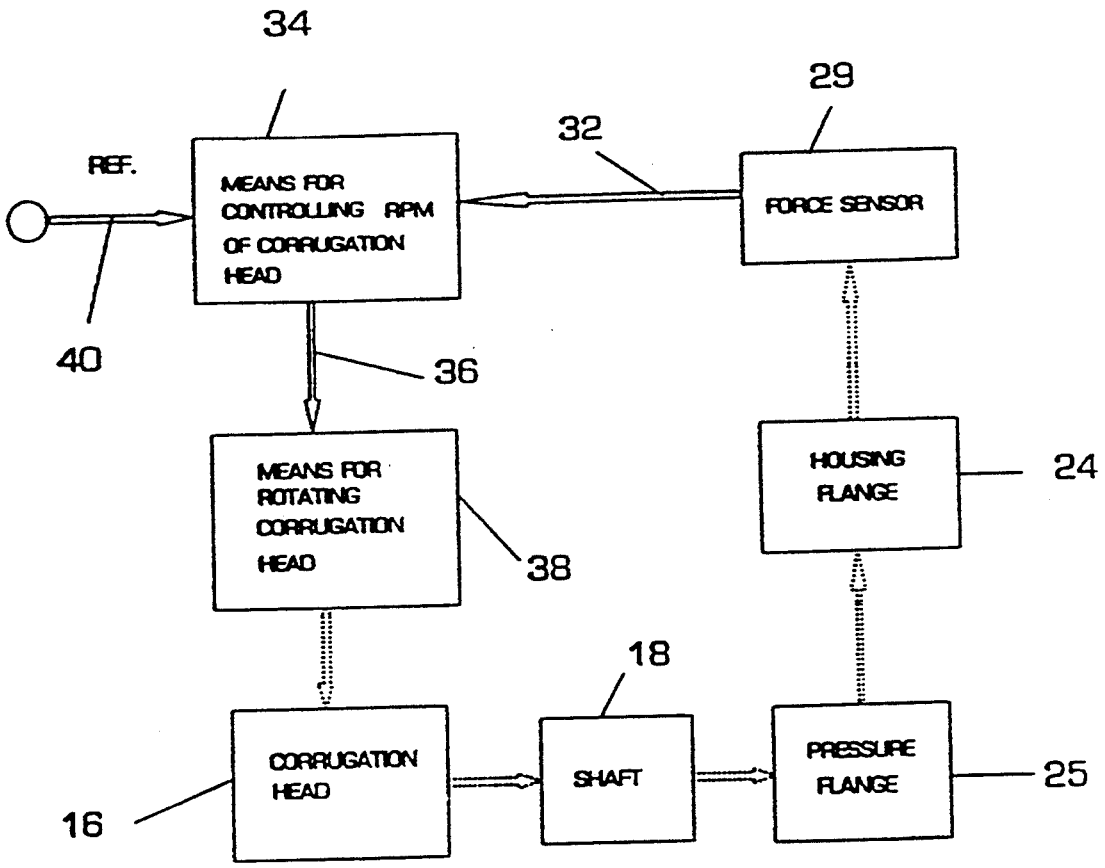
FIG. 4 shows a control, according to the invention.
Figure 5:
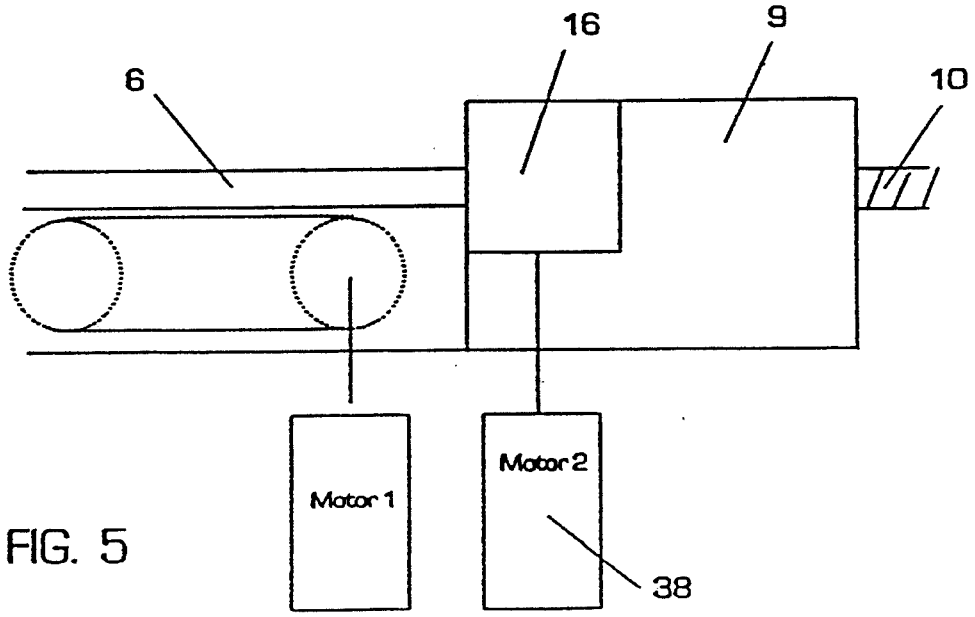
FIG. 5 shows that separate motors may be used for traction and corrugation.

The force measuring sensor 29 as shown in FIG. 4, or each force measuring sensor, provides a sensed signal on a line 32 to a control circuit 34, which provides a drive signal on a line 36 for controlling, for example, the RPM of a motor 38, preferably an electric motor, that drives the corrugation head 16. The control 34 may be of any selected type of known motor controls for controlling a selected parameter such as speed in open or closed loop fashion. Typically, it would be at least responsive to a reference signal, such as a speed command, on a line 40.

In this manner, the selected parameter, such as the corrugation RPM, is quickly adapted to changed conditions.

The force existing at each force measuring sensor 29 may be registered by a not shown recorder, and enclosed with the finished tube lengths as a production record.

We claim:

1. Apparatus for the continuous production of a helical or annularly corrugated, thin-walled, in particular longitudinally welded metal tube, the apparatus comprising a housing in which a corrugation head is located coaxial to the metal tube running through, the corrugation head having a freely rotating the roller ring, the apparatus also having attraction device for running through the metal tube, wherein the roller ring and thereby the corrugation head, and mechanically attached parts thereof, have a limited axial displacement with respect to the housing, wherein the apparatus further comprises a force measuring device, wherein the roller ring, the corrugation head or at least one part of the mechanically attached parts affects the force measuring device for measuring axial forces that cause the axial displacement, wherein the apparatus further comprises an angular velocity controller and a motor for driving the corrugation head under the control of the controller wherein the angular velocity of the motor is controlled as a function of a force measured by the force measuring device.

2. Apparatus according to claim 1, further comprising a rotating hollow shaft attached to the corrugation head for rotating on a roller bearing mounted on the housing to a side of the corrugation head, the roller bearing having an outside bearing shell for pressing against a pressure flange attached to the housing in proportion to the axial displacement, the pressure flange having a one hundred and eighty degree bent finger attached to it, a free end of the finger enclosing the force measuring device between the finger and the housing.

3. Apparatus according to claim 1, wherein the force measuring device comprises three force measuring devices offset by one hundred and twenty degrees with respect to each other.

4. Apparatus according to claim 2, wherein the finger is attached to the pressure flange by screws.

5. Apparatus according to claim 2, wherein the hollow shaft is located in the housing by means of the roller bearing without a rim on an inside ring.

* * * * *